US012358689B2

(12) United States Patent
Kelly

(10) Patent No.: US 12,358,689 B2
(45) **Date of Patent: *Jul. 15, 2025**

(54) POP-UP GIFT BAG

(71) Applicant: American Greetings Corporation, Cleveland, OH (US)

(72) Inventor: Charles Robert Kelly, Amherst, OH (US)

(73) Assignee: American Greetings Corporation, Cleveland, OH (US)

( * ) Notice: Subject to any disclaimer, the term of this patent is extended or adjusted under 35 U.S.C. 154(b) by 79 days.

This patent is subject to a terminal disclaimer.

(21) Appl. No.: 18/219,799

(22) Filed: Jul. 10, 2023

(65) Prior Publication Data

US 2023/0348145 A1 Nov. 2, 2023

Related U.S. Application Data

(63) Continuation-in-part of application No. 17/682,398, filed on Feb. 28, 2022, now Pat. No. 11,738,908.

(60) Provisional application No. 63/154,881, filed on Mar. 1, 2021.

(51) Int. Cl.
*B65D 33/00* (2006.01)
*B65D 30/00* (2006.01)

(52) U.S. Cl.
CPC ..... *B65D 33/004* (2013.01); *B65D 31/00* (2013.01)

(58) Field of Classification Search
CPC ..... B65D 33/004; B65D 33/02; B65D 33/12; B65D 31/00
USPC ..... 383/38–40
See application file for complete search history.

(56) References Cited

U.S. PATENT DOCUMENTS

| | | | | |
|---|---|---|---|---|
| 4,243,171 | A | 1/1981 | Prin | |
| 5,613,312 | A | 3/1997 | Crowell | |
| 6,345,912 | B1 | 2/2002 | Ho | |
| 9,592,933 | B1 | 3/2017 | Campbell | |
| D801,191 | S | 10/2017 | Unger et al. | |
| 9,802,734 | B1 | 10/2017 | McCambridge et al. | |
| 9,987,871 | B1 * | 6/2018 | Larson | B42D 15/045 |
| 10,364,068 | B1 | 7/2019 | Kacines | |
| 11,738,908 | B2 * | 8/2023 | Kelly | B65D 33/12 383/40 |
| 2009/0050505 | A1 * | 2/2009 | Rubin | B65D 33/004 383/105 |
| 2014/0033651 | A1 * | 2/2014 | Cunningham | B65D 33/004 53/411 |
| 2014/0190850 | A1 * | 7/2014 | Glass | G09F 1/06 206/232 |
| 2015/0210434 | A1 * | 7/2015 | Miller | B65D 85/60 383/41 |
| 2015/0314921 | A1 * | 11/2015 | Mayer | G09F 19/00 383/105 |
| 2018/0057216 | A1 | 3/2018 | McCambridge et al. | |
| 2021/0221569 | A1 * | 7/2021 | Bowman | B65D 33/004 |

* cited by examiner

*Primary Examiner* — Jes F Pascua
(74) *Attorney, Agent, or Firm* — Christine Flanagan

(57) ABSTRACT

A gift bag with a pocket containing an integral pop-up structure which is operative to move between a first position wherein the pop-up structure is in a substantially flat position and substantially contained within the pocket of the gift bag, and a second position wherein the pop-up structure is unfolded into a three-dimensional structure that is substantially contained outside of the pocket of the gift bag.

17 Claims, 8 Drawing Sheets

POP-UP GIFT BAG

RELATED APPLICATIONS

This application is a continuation-in-part of and claims priority to U.S. patent application Ser. No. 17/682,398, filed on Feb. 28, 2022, which is a non-provisional of and claims priority to U.S. Provisional Patent Application No. 63/154,881, filed on Mar. 1, 2021. A copy of the above-referenced patent applications are incorporated herein by reference.

FIELD OF THE INVENTION

The present invention is in the field of social expression products such as greeting cards, gift bags, gift wrap, gift accessories and such.

SUMMARY OF THE INVENTION

In one embodiment, the pop-up gift bag of the present disclosure and related invention includes a gift bag body having a front side, a back side opposite the front side, a right side between the front and back sides, a left side opposite the right side and between the front and back sides, a bottom panel attached to the front, back, right and left side panels creating a closed end opposite an open end, an outer pocket contained on the exterior of the gift bag body, a 3D pop-up structure operative to move between a first position, wherein the 3D pop-up structure is folded substantially flat and contained inside the outer pocket and a second position, wherein the 3D pop-up structure is unfolded and erect and contained outside the outer pocket.

In another embodiment, the pop-up gift bag includes a gift bag body, a first outer pocket on the gift bag body, a second outer pocket on the gift bag body, a third outer pocket contained within the first outer pocket, a fourth outer pocket contained within the second outer pocket, where the third and fourth outer pockets each comprising a slotted panel, the slotted panel having two elongate slots thereon, a first 3D pop-up structure contained within the third outer pocket, a second 3D pop-up structure contained within the fourth outer pocket, where each of the first and second 3D pop-up structures comprising a slider panel and a 3D pop-up display attached to the slider, where the slider panels engage with the slotted panels to move along the elongate slots contained on the slotted panels, and where the first and second 3D pop-up structures are operative to move between a first position where the first and second 3D pop-up structures are folded inside the third and fourth outer pockets and a second position where the first and second 3D pop-up structures are unfolded outside the third and fourth outer pockets.

In still another embodiment, the pop-up gift bag includes a gift bag body comprising a first main panel and a second main panel opposite and parallel to the first panel, a first side panel and a second side panel opposite and parallel to the first side panel, and a bottom panel which connects the first and second main panels to the right and left side panels, creating a closed end of the gift bag which is opposite an open end of the gift bag, a four-sided reinforcement panel attached to an inside surface of the first main panel of the gift bag along three side edges, creating a first outside pocket therebetween, a slot contained on the first main panel which provides access to the first outside pocket, a four-sided slotted panel having two elongate vertical slots contained thereon, the slotted panel being connected to the reinforcement panel along three side edges, creating a second outside pocket, a pop-up structure contained within the second outside pocket, the pop-up structure comprising a backer panel, a slider panel, a pop-up panel, and a 3D pop-up display, the pop-up panel having an upper portion and a lower portion connected along a horizontal fold line, a portion of the 3D pop-up display attached to an inner surface of the upper portion of the pop-up panel and a portion of the 3D pop-up display attached to an inner surface of the lower portion of the pop-up panel, the backer panel being attached to an outer surface of the upper portion of the pop-up panel, the slider panel being attached to an outer surface of the lower portion of the pop-up panel, wherein the slider panel engages with the slotted panel to allow the slider panel to move up and down along the slotted panel, wherein the 3D pop-up structure is operative to move between a first position wherein it is folded into a substantially flat position contained within the first and second outside pockets of the gift bag and a second position wherein it is unfolded outside of the first and second outside pockets of the gift bag.

DETAILED DESCRIPTION OF PREFERRED AND ALTERNATE EMBODIMENTS

Figure 1:
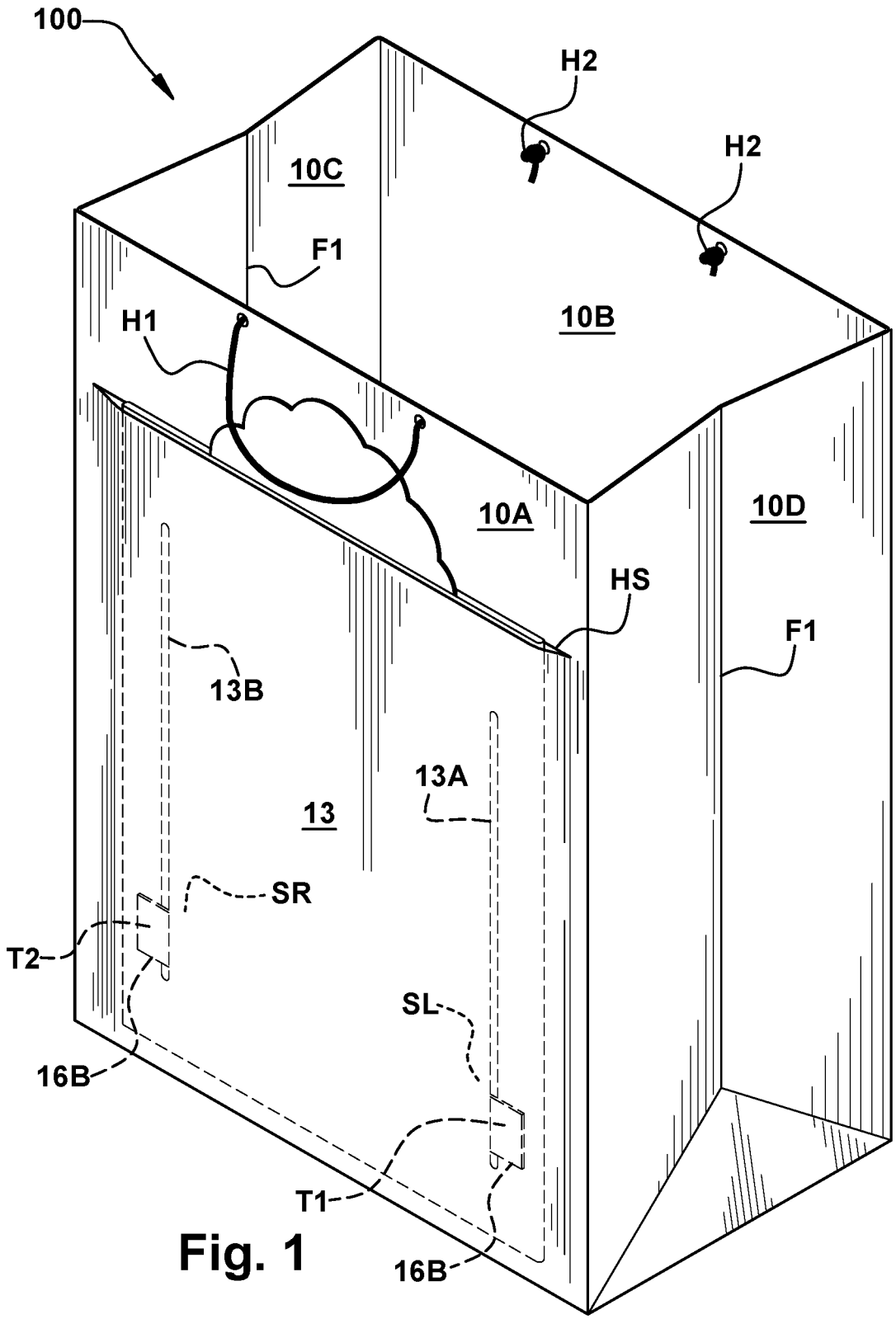
FIG. 1 is a perspective view of the gift bag of the present invention, with pop-up in collapsed, hidden position.
Figure 2:
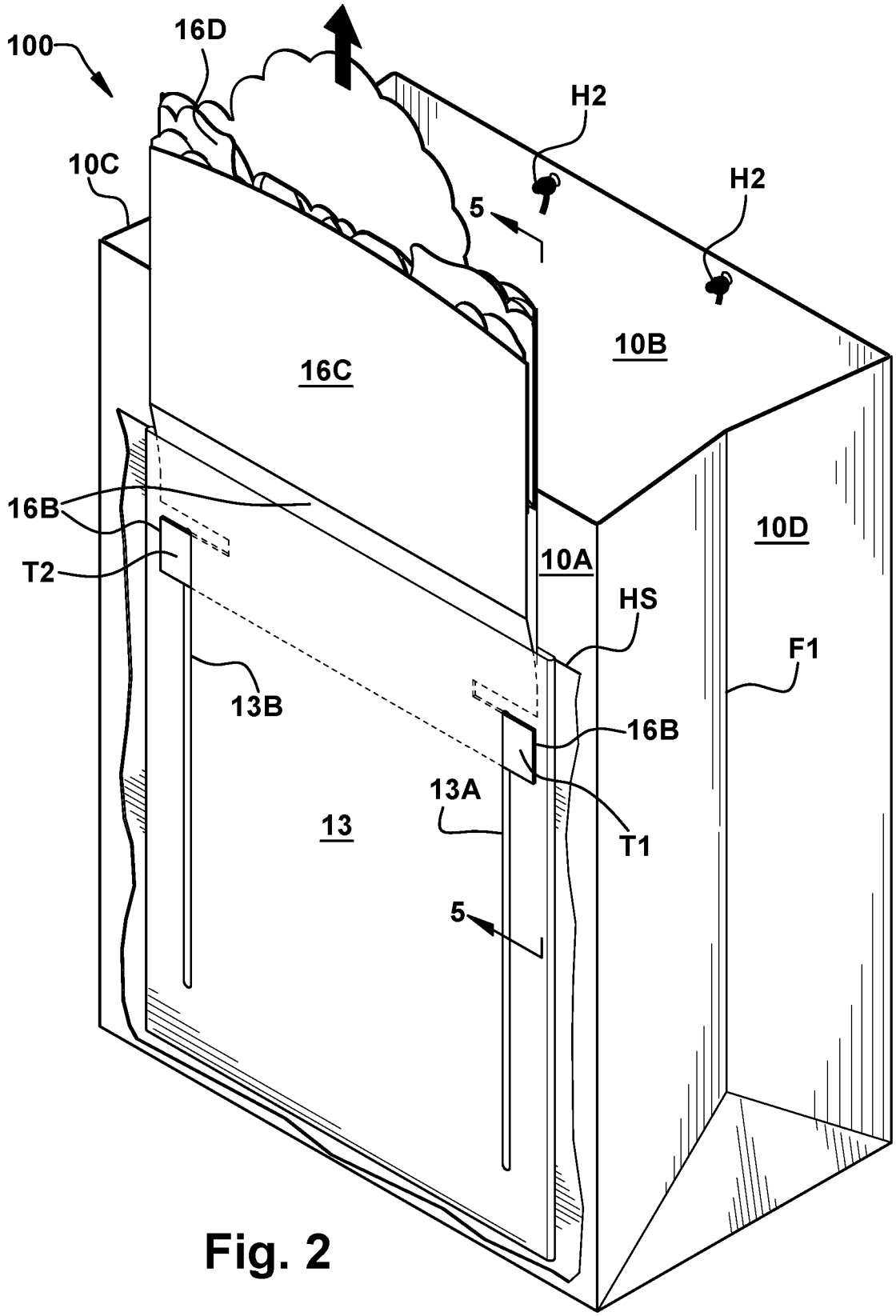
FIG. 2 is a perspective view of the gift bag of FIG. 1, with pop-up in a partially removed position.
Figure 3:
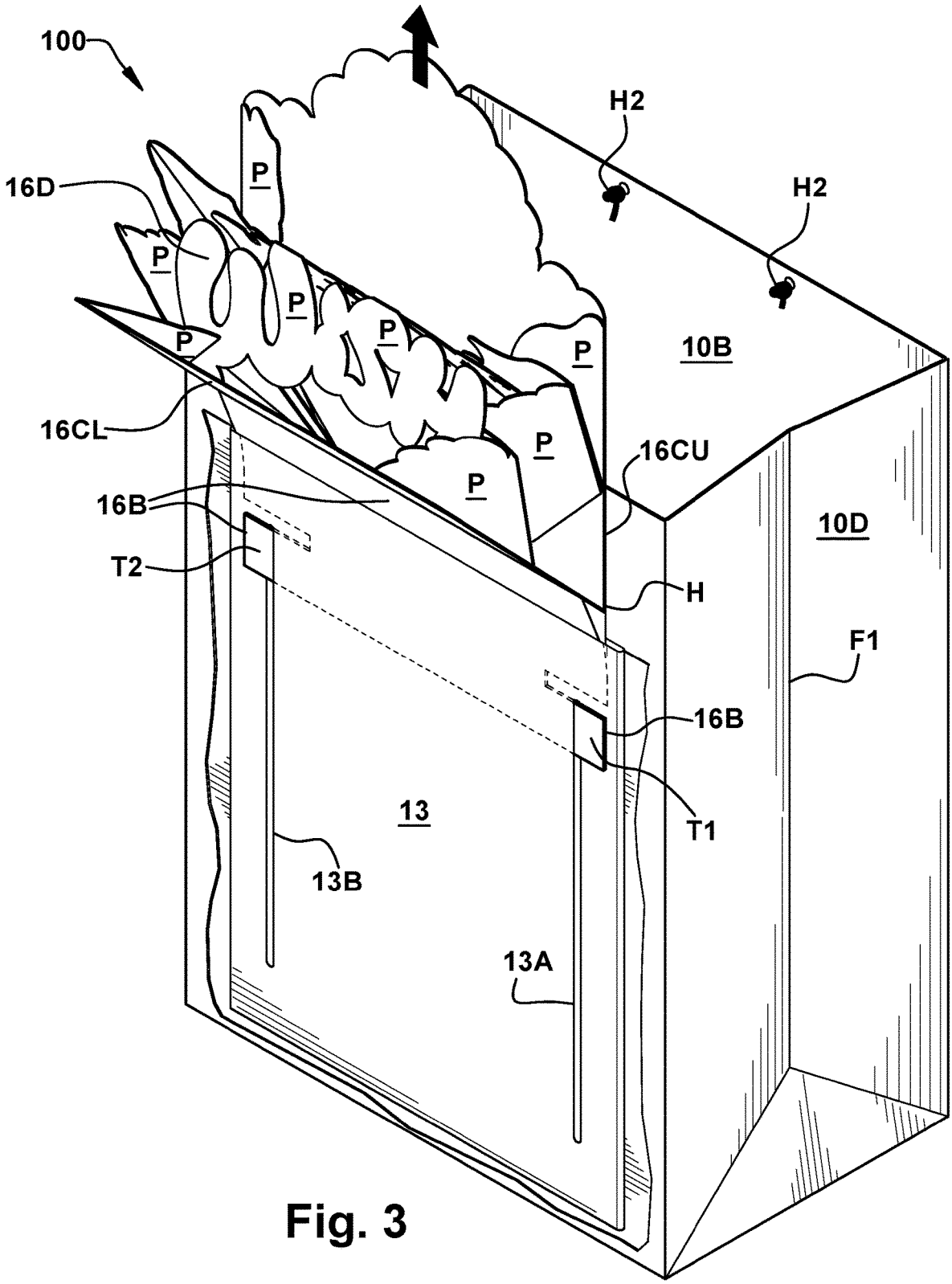
FIG. 3 is a perspective view of the gift bag of FIG. 1, with pop-up in a partially removed position.
Figure 4:
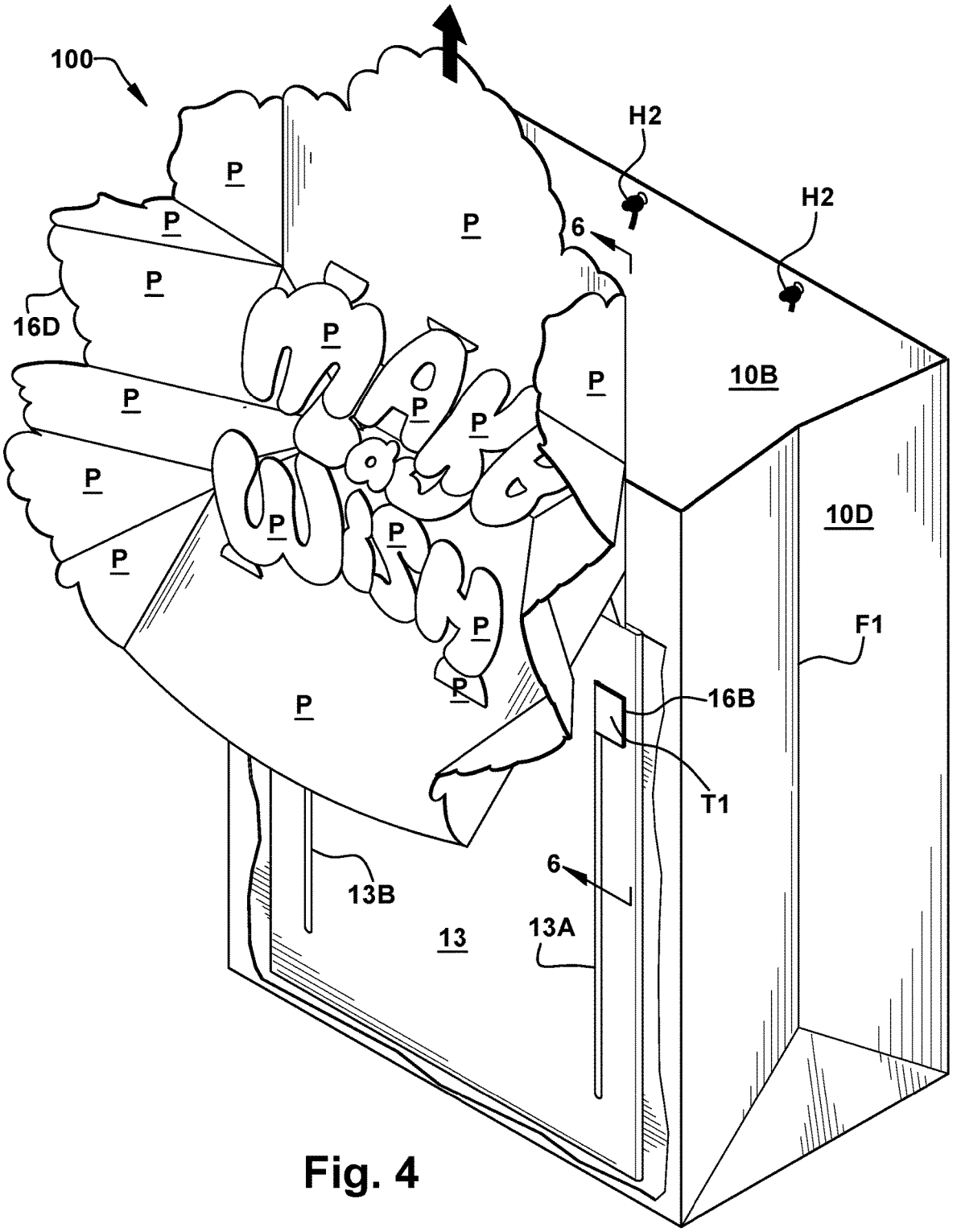
FIG. 4 is a perspective view of the gift bag of FIG. 1, with pop-up in a fully removed position.

The present disclosure and related inventions is directed to a gift bag with a pop-up structure 100. The gift bag 10 contains an exterior pocket which houses a pop-up structure 18. Pulling upward on a portion of the pop-up structure 18 causes it to be substantially removed from the exterior pocket on gift bag 10 and revealing a three-dimensional (3D) pop-up display 18C. Pushing downward on the pop-up structure 18 causes the pop-up display 18C to collapse back into the exterior pocket of the gift bag 10. The pop-up display 18C can repeatedly be opened (erected outside gift bag pocket) and closed (folded and returned to outside gift bag pocket).

The gift bag 10 may be of conventional design having a front panel 10A and a back panel 10B opposite the front panel 10A with two side panels 10C, 10D extending therebetween. The width of the side panels 10C, 10D controls the width of the gift bag 10. A bottom panel 10E connects each of the front 10A, back 10B and side panels 10C, 10D to create one closed end of the gift bag 10. Opposite the closed end is an open end for insertion of a gift or other item into the gift bag 10. The side panels 10C, 10D may contain a vertical bisecting fold line or crease F1 which creates a side gusset and enables the gift bag 10 to be neatly folded and packaged for display and/or retail sale. Each of the gift bag panels 10A, 10B, 10C, 10D contain an inner surface (located on the inside of the gift bag 10) and an outer surface (located outside of the gift bag 10). The gift bag 10 may also contain two handles H1, 112, a first handle H1 attached to the front panel 10A and a second handle 112 attached to the back panel 10B of the gift bag 10. The handles H1, H2, as shown in the figures, may be similar to a rope or cord-like structure which extend between two holes or openings positioned proximate to the upper edges of the front and back gift bag panels 10A, 10B along the open end of the gift bag 10. For example, for each handle H1, H2 a single piece of cord or rope-like structure may be used. The two free ends of the first cord are inserted into the two holes on the front panel 10A of the gift bag 10 and the two free ends of the second cord are inserted into the two holes on the back panel 10B of the gift bag 10. The cords may be inserted into each hole from the outside of the gift bag 10 to the inside of the gift bag 10 where each free end of the cord is tied or knotted for secure attachment to the gift bag 10 or alternatively, the cords may be inserted from the inside of the gift bag 10 to the outside of the gift bag 10, where each free end is then tied or knotted. In other embodiments, the handles may be die cut from the front and back gift bag panels 10A, 10B. Handles 111, 112 may be attached from gusset to gusset or may be glued or otherwise attached to an inner surface of the gift bag 10. In still other embodiments, the gift bag 10 may contain other types of handles, such as paperboard handles, plastic handles, or any other suitable handle which may or may not be removable from the gift bag. Interchangeable handles may also be used in combination with the gift bag 10 of the present invention. Each gift bag 10 may contain drawings, images, photos or other printed indicia on the front panel 10A, back panel 10B, right and left side panels 10C, 10D, and bottom panel 10E of the gift bag 10.

A horizontal slot HS is contained on the front panel 10A of the gift bag 10. A reinforcement panel 14 is attached to the inside surface of the front panel 10A of the gift bag 10, which closes access from the horizontal slot HS into the interior of the gift bag 10 and creates a first outer pocket or cavity (on the exterior or the gift bag 10) between the reinforcement panel 14 and the front panel 10A of the gift bag 10.

A slotted panel 13 is attached to the reinforcement panel 14 (inside the first outer pocket) along three sides thereof, leaving the upper edge free, thereby creating a second outer pocket between the reinforcement panel 14 and the slotted panel 13. The slotted panel 14 contains two elongate, vertical slots contained thereon. A first slot 13A located proximate the left side edge of the slotted panel and a second slot 13B, parallel to the first slot 13A and proximate the right-side edge of the slotted panel 13, as shown in FIGS. 1-4).

Figure 5:
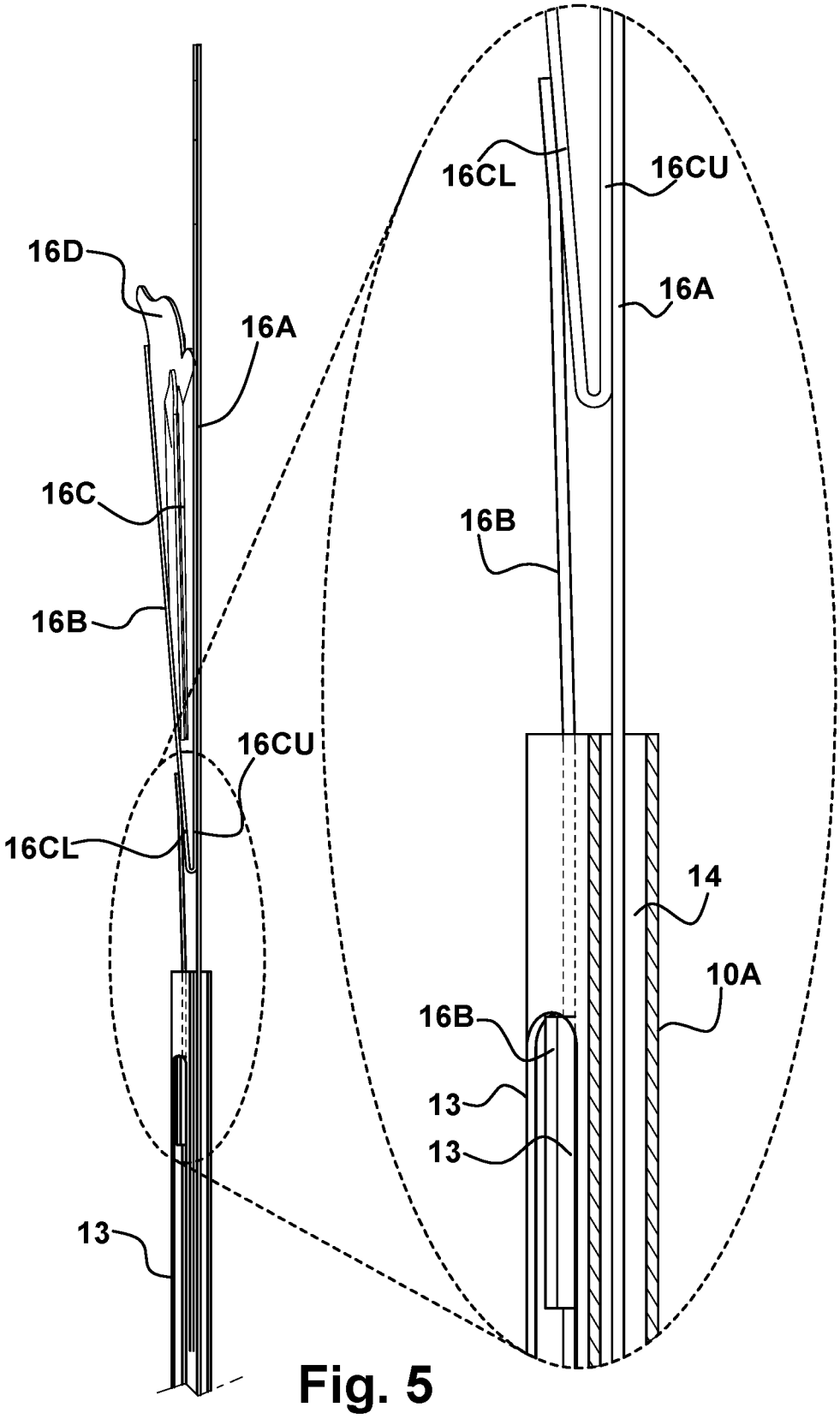
FIG. 5 is a right-side close-up view of the pop-up of FIG. 2.
Figure 6:
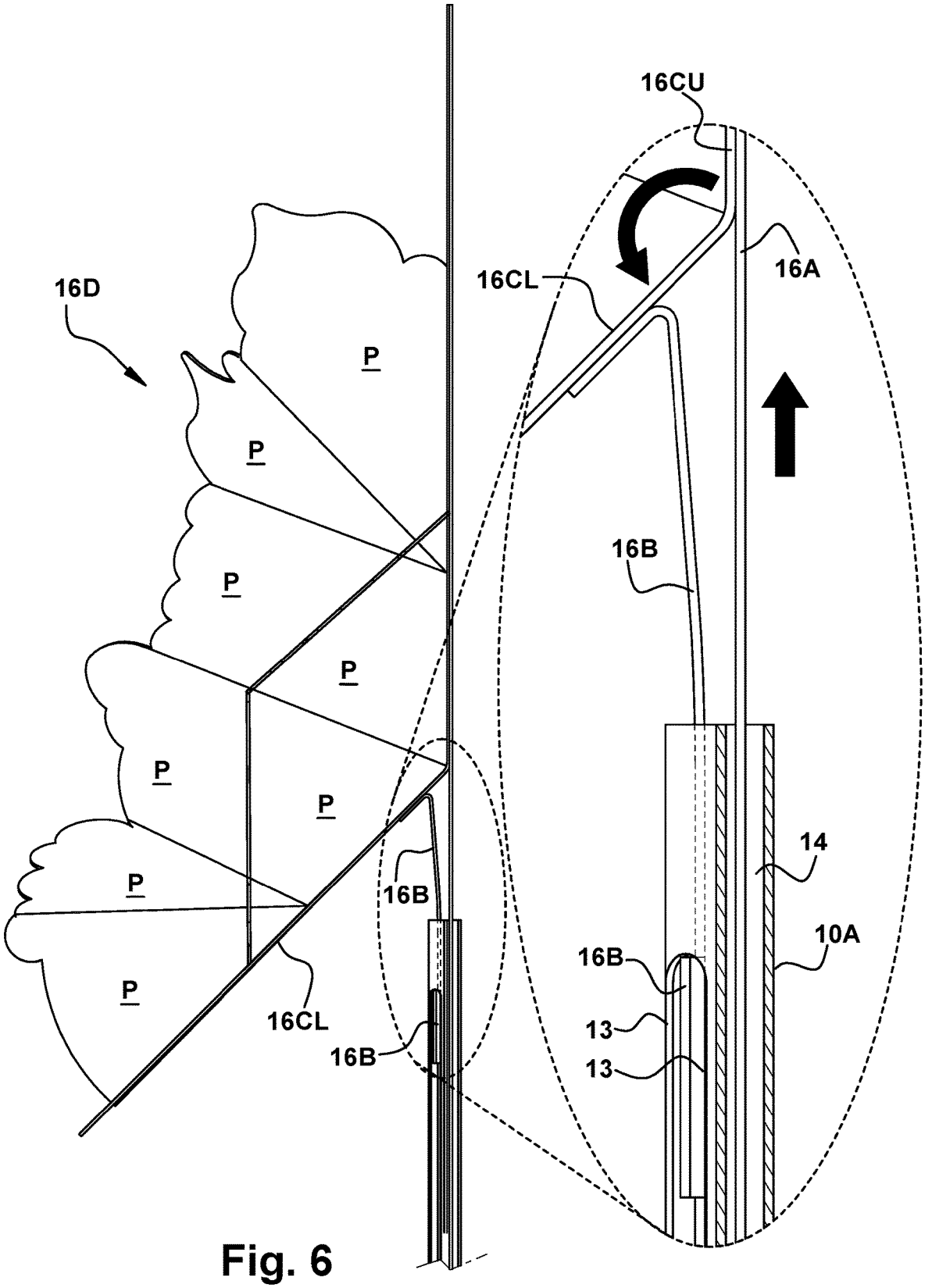
FIG. 6 is a right-side close-up view of the pop-up of FIG. 4.

A pop-up structure 16, comprising a backer panel 16A, a slider panel 16B, a pop-up panel 16C, and a 3D pop-up display 16D, is located inside the second outer pocket or cavity between the slotted panel 13 and the reinforcement panel 14. The slider panel 16B contains two vertical slots thereon. A first slot SR which extends inward from a right-side edge approximately 1" to 1.5" and a second slot SL which extends inward from a left side edge approximately 1"-1.5". Both the first and second slot SR, SL are positioned approximately 1" up from the lower edge of the slider panel 16B, thereby creating two notches or tabs T1, T2 at the lower end of the slider panel 16B. When the pop-up structure 16 is inserted into the second outer pocket (between the slotted panel 13 and reinforcement panel 14), the tabs T1, T2 are inserted into the slots SL, SR. This enables the slider panel 16B to slide along (up and down) the slots SL, SR on the slotted panel 13, and also prevents the pop-up structure 16 from being completely removed from the first and second outer pockets. The backer panel 16A of the pop-up structure 16 serves as the base or backing for the pop-up structure 16. The pop-up panel 16C contains a horizontal fold line thereon HL on which the pop-up panel 16C is folded upward into a V-shape and creating an upper pop-up panel 16CU (above the fold line HL) and a lower pop-up panel 16CL (below the fold line HL), as can be seen in FIG. 5. The outside surface of the upper pop-up panel 16CU is attached to the backer panel 16A and the outside surface of the lower pop-up panel 16CL is attached to the slider panel 16B. The 3D pop-up display 16D contains various pieces or panels P which are strategically shaped, connected and folded to form the 3D pop-up display 16D. The 3D pop-up display 16D is attached between the inside surfaces of the upper and lower pop-up panels 16CU, 16CL. The 3D pop-up display 16D can move between a first position (shown in FIG. 1), wherein it is folded into a substantially flat position and (along with a substantial portion of the backer panel 16A, slider panel 16B, and pop-up panel 16C) it is substantially contained within the first and second outer pockets of the gift bag 10, and a second position (shown in FIG. 4), wherein it is unfolded and erect and contained (along with the backer panel 16A, slider panel 16B, and pop-up panel 16C) outside the first and second outer pockets of the gift bag 10. When the pop-up structure 16 is contained within the first and second outer pockets of the gift bag 10 the upper and lower panels 16CU, 16CL of the pop-up panel 16 are forced closed with the interior of the upper panel 16CU and the interior of the lower panels 16CL facing each other (with 3D pop-up display in-between). When the slider panel 16B reaches the top of the slots SR, SL on the slotted panel 13, the lower panel drops down (folding a portion of the slider panel 16B downward) to reveal the 3D pop-up display 16D, as shown in FIG. 6.

In operation, when the 3D pop-up display 16D is in the first or folded position, a portion of the pop-up structure 16 is visible outside of the first and second outer pockets of the gift bag (peeking out of the slot or aperture on the front gift bag panel 10A). A user can grip part of the visible portion of the pop-up structure 16, such as between a forefinger and thumb and pull upward to move the pop-up display 16D from the first position to the second position, as the slider panel 16B moves upward along the two elongate slots 13A, 13B on the slotted panel 13. In the second position, the pop-up display 16D is fully unfolded and erect outside of the first and second outer pockets on the gift bag. It will remain in the second position until a user grips a portion of the pop-up structure 16, again, such as between a forefinger and thumb, and applies a downward pressure to collapse the pop-up structure 16 (including 3D pop-up display 16D) back into the first and second outer pockets on the gift bag 10. The pop-up structure 16 and 3D pop-up display 16D can be continuously moved between the first and second positions.

The gift bag of the present disclosure and related inventions may additionally contain a sound module which is operable to store and record sound to be played upon the pop-up structure being moved from the first to second positions.

Figure 7:
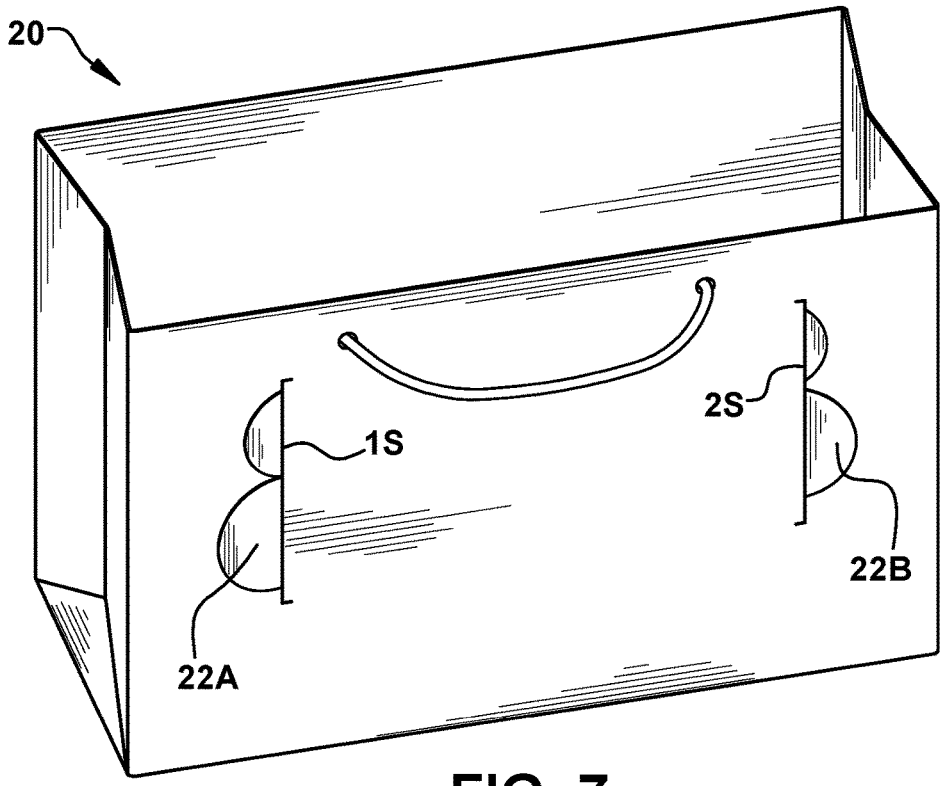
FIG. 7 is a perspective view of an alternate embodiment, with pop-up in closed position.
Figure 8:
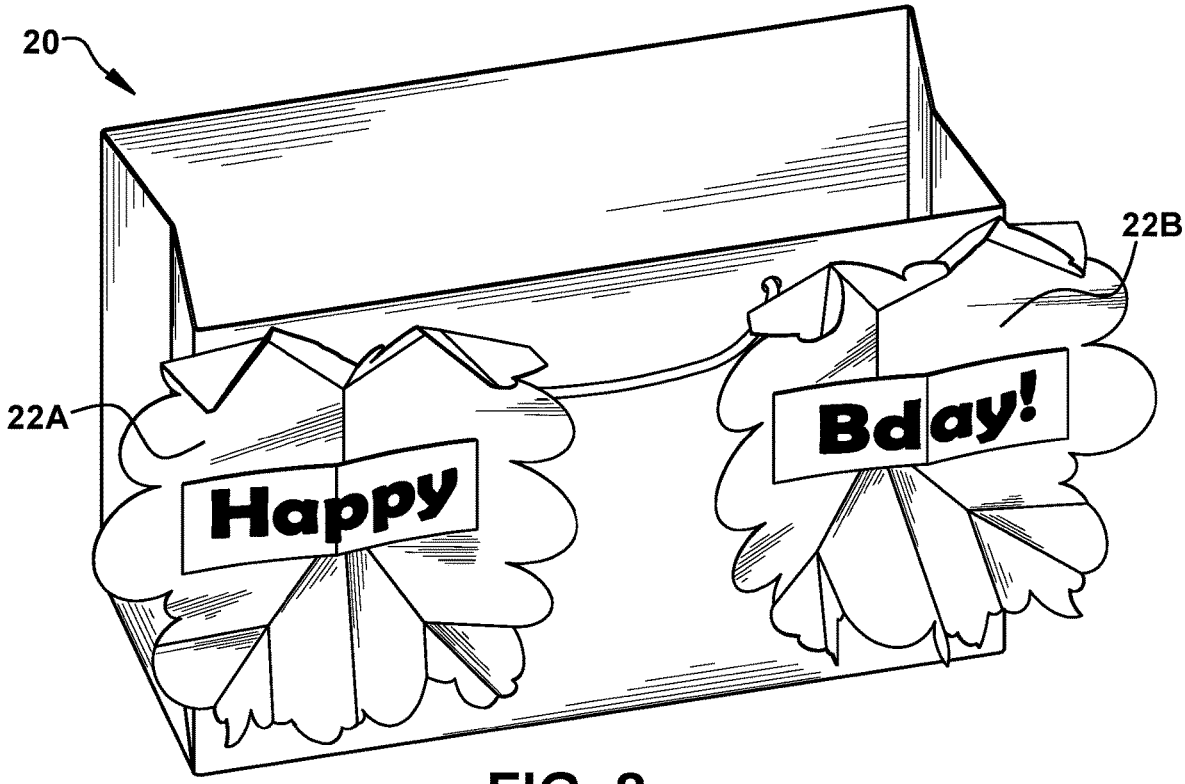
FIG. 8 is a perspective view of FIG. 7, with pop-up in fully removed position.
Figure 9:
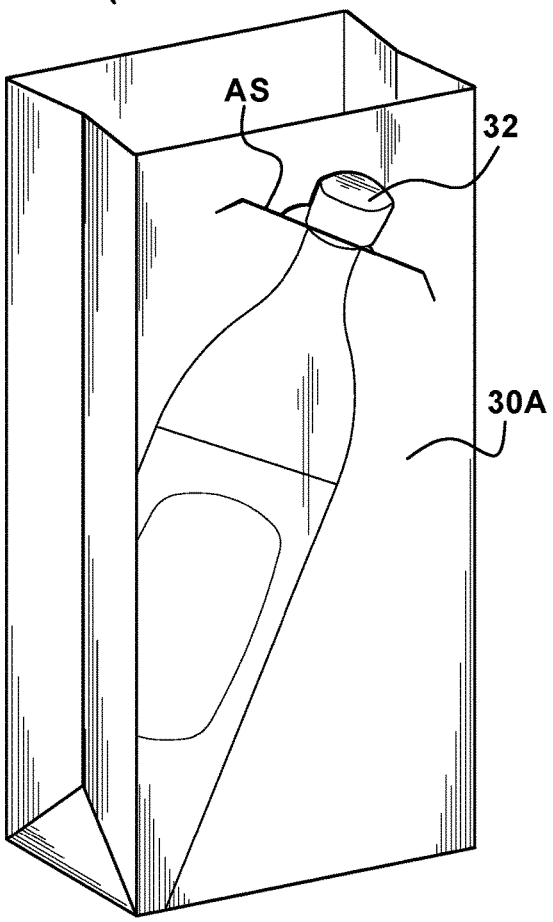
FIG. 9 is a perspective view of another alternate embodiment, with pop-up in closed position.
Figure 10:
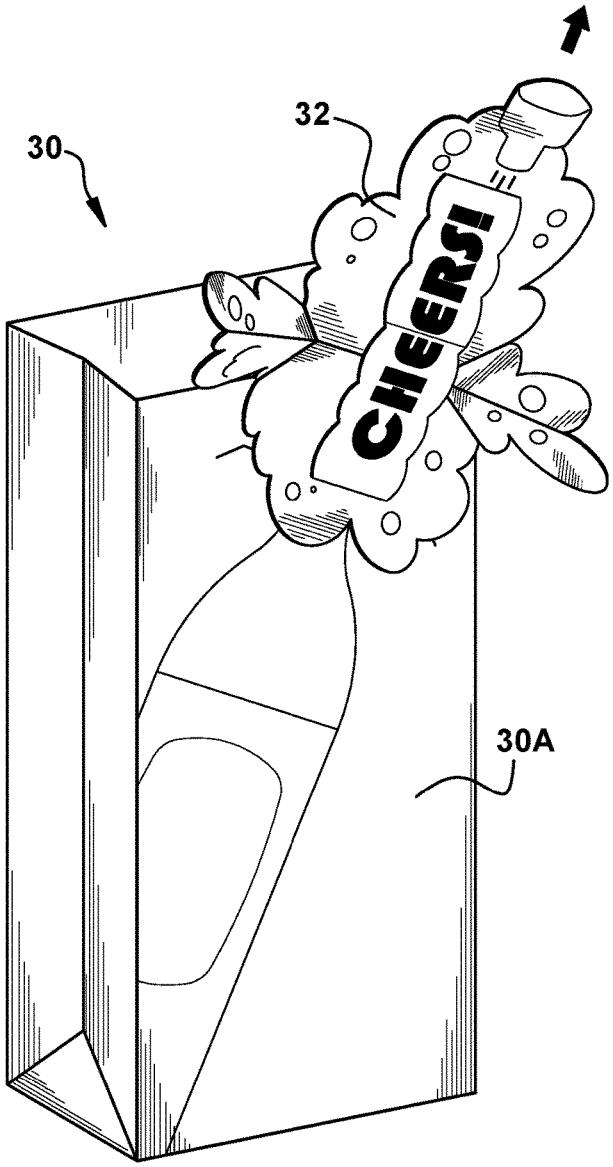
FIG. 10 is a perspective view of FIG. 9, with pop-up in fully removed position.

In other embodiments, as shown in FIGS. 7-10, the bags contain the same internal mechanical structure for moving a pop-up structure from substantially within a pocket to substantially outside of the pocket (outer pocket, slotted panel, slider panel and pop-up element, etc.) as described above with regard to the embodiment shown in FIGS. 1-6. However, the pop-up element may emerge from the gift bag from angled or vertical slots (as opposed to the horizontal slot of the embodiment of FIGS. 1-6). For example, as shown in FIGS. 9 and 10, the gift bag 30 is a tall and slender and of the type typically used for carrying wine or other bottled substance. It contains an angled slot AS on the front panel 30A of the gift bag 30, through which the pop-up structure 32 emerges when pulled from the bag 30 by the user. Another example is shown in FIGS. 7 and 8, which is a wide bag 20 (wider than it is tall) that has two vertical slots, a first slot 1S being proximate to a right edge of the bag 20 and a second slot 2S being proximate to a left side of the bag 20, each slot 1S, 2S, providing access to a pop-up structure 22A, 22B. As disclosed above, a portion of the pop-up structure 22A, 22B is visible outside of the gift bag 20 when the gift bag 20 is in the first position. The user may grip a portion of each of the visible portions of the pop-up structures 22A, 22B and pull outward in opposing directions, to reveal the full pop-up structures 22A, 22B emerging from the two vertical slots 1S, 2S contained on the gift bag 20.

In another embodiment, the pop-up structure is completely removable from the gift bag. For example, the pop-up structure may be a faux flower bouquet or potted plant. When it is pulled from the gift bag is completely removable and can stand alone as a decorative item or keepsake that the user can display on his/her desk, mantle, table, or other level structure. The pop-up structure may have a tab or other such mechanism that locks the pop-up into the second, erect or upright position.

In still another embodiment, the gift bag may contain a double pop-up or a pop-up within a pop-up. The bag can be of the type described above, with a second pop-up structure embedded with or attached to a first pop-up (as disclosed above). The user can remove the first pop-up from the gift bag and then remove a second pop-up from within the first, opened or extended position of the first pop-up. The two pop-up structures may be similar, such as for example, a flower within a flower, or they may be different such as sunshine within a rain cloud.

In still another embodiment, the front panel of the gift bag may have perforations thereon that allows a user to fully remove the front panel which would also serve as a greeting card with the pop-up structure contained therein. In an alternate embodiment, the front panel of the gift bag may be removed along the perforated lines and serve as a base for the pop-up structure.

The pop-up gift bag of the present disclosure and related inventions is versatile and adaptable to many occasions or events, such as, for example a pop-up flower bouquet for Mother's Day, hearts for Valentine's Day, balloons for a birthday, a Christmas tree for Christmas, etc. The gift bag can also be decorated or adorned with related print, text sentiment, photos, drawings, etc. Three dimensional items may also be used on the outside of the gift bag, such as gems, googly eyes, faux fur, etc.

While the gift bag and pop-up structure have been described herein as having a particular form, such as the standard gift bag shape, etc., other gift bag and pop-up shapes have been contemplated and are considered to be within the scope of the present invention. For example, the gift bag may be otherwise shaped, such as a triangle, circle, or other such shape. In other embodiments, the pop-up structure may be removable from the gift bag. Also, the pocket containing the pop-up structure may be in the inside or outside of the gift bag and may be attached to any gift bag surface, interior or exterior.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A pop-up gift bag comprising:

a gift bag body having a front side, a back side opposite the front side, a right side between the front and back sides, a left side opposite the right side and between the front and back sides, a bottom panel attached to the front, back, right, and left side panels creating a closed end opposite an open end;

a first outer pocket contained on the exterior of the gift bag body;

a second outer pocket contained within the first outer pocket, the second outer pocket comprising a slotted panel having two elongate slots thereon;

a 3D pop-up structure located within the second outer pocket, the 3D pop-up structure engaged with the slotted panel to slide along the two elongate slots on the slotted panel;

wherein the 3D pop-up structure is moveable between a first position, wherein the 3D pop-up structure is folded within the second outer pocket, and a second position, wherein the 3D pop-up structure is unfolded outside the second outer pocket.

2. The pop-up gift bag of claim 1, wherein a portion of the 3D pop-up structure is visible outside the outer pocket of the gift bag when it is in the second position.

3. The pop-up gift bag of claim 1, wherein the front side of the gift bag contains an angled slot thereon which provides access to the outer pocket.

4. The pop-up gift bag of claim 1, wherein the 3D pop-up structure cannot be completely removed from the outer pocket on the gift bag.

5. The pop-up gift bag of claim 1, wherein the front side of the gift bag contains a first vertical slot and a second vertical slot.

6. A pop-up gift bag comprising:

a gift bag body;

a first outer pocket on the gift bag body;

a second outer pocket on the gift bag body;

a third outer pocket contained within the first outer pocket;

a fourth outer pocket contained within the second outer pocket;

the third and fourth outer pockets each comprising a slotted panel, the slotted panel having two elongate slots thereon;

a first 3D pop-up structure contained within the third outer pocket;

a second 3D pop-up structure contained within the fourth outer pocket;

each of the first and second 3D pop-up structures comprising a slider panel and a 3D pop-up display attached to the slider;

wherein the slider panels engage with the slotted panels to move along the elongate slots contained on the slotted panels;

wherein the first and second 3D pop-up structures are operative to move between a first position wherein the first and second 3D pop-up structures are folded inside the third and fourth outer pockets and a second position wherein the first and second 3D pop-up structures are unfolded outside the third and fourth outer pockets.

7. The pop-up gift bag of claim 6, wherein the first, second, third, and fourth outer pockets are accessed through two separate slots on the gift bag.

8. The pop-up gift bag of claim 6, wherein the first and second outer pockets are accessed through two vertical slots on the gift bag.

9. The pop-up gift bag of claim 6, wherein a portion of the first 3D pop-up structure extends outside the first and third outer pockets and the second 3D pop-up structure extends outside the second and fourth outer pockets when they are in the first position.

10. The pop-up gift bag of claim 6, wherein the two 3D pop-up structures cannot be completely removed from the first and second outer pockets.

11. The pop-up gift bag of claim 6 wherein the first and second 3D pop-up structures can be completely removed from the first, second, third, and fourth outer pockets.

12. The pop-up gift bag of claim 6, wherein the first and second 3D pop-up structures are moved from the first position to the second position by a user manually pulling outward on a portion of the first and second pop-up structures that extends outside the first, second, third, and fourth pockets when the 3D pop-up structure is in the first position.

13. A gift bag comprising:

a gift bag body comprising a first main panel and a second main panel opposite and parallel to the first panel, a first side panel and a second side panel opposite and parallel to the first side panel, and a bottom panel which connects the first and second main panels to the right and left side panels, creating a closed end of the gift bag which is opposite an open end of the gift bag;

a four-sided reinforcement panel attached to an inside surface of the first main panel of the gift bag along three side edges, creating a first outside pocket therebetween;

a slot contained on the first main panel which provides access to the first outside pocket;

a four-sided slotted panel having two elongate slots contained thereon, the slotted panel being connected to the reinforcement panel along three side edges, creating a second outside pocket;

a pop-up structure contained within the second outside pocket, the pop-up structure comprising a backer panel, a slider panel, a pop-up panel, and a 3D pop-up display;

the pop-up panel having an upper portion and a lower portion connected along a fold line, a portion of the 3D pop-up display attached to an inner surface of the upper portion of the pop-up panel and a portion of the 3D pop-up display attached to an inner surface of the lower portion of the pop-up panel;

the backer panel being attached to an outer surface of the upper portion of the pop-up panel;

the slider panel being attached to an outer surface of the lower portion of the pop-up panel;

wherein the 3D pop-up structure is operative to move between a first position wherein it is folded into a substantially flat position contained within the first and second outside pockets of the gift bag and a second position wherein it is unfolded outside of the first and second outside pockets of the gift bag.

14. The pop-up gift bag of claim 13, wherein the 3D popup display cannot be completely removed from the second outside pocket of the gift bag.

15. The pop-up gift bag of claim 13, wherein the 3D pop-up display can be completely removed from the second outside pocket of the gift bag.

16. The pop-up gift bag of claim 13, wherein a portion of the pop-up structure extends outside of the first and second outside pockets.

17. The pop-up gift bag of claim 13, wherein the 3D pop-up display is moved from the first position to the second position by a user manually pulling outward on the portion of the pop-up structure that extends outside the pocket when the 3D pop-up display is in the first position.

* * * * *